US007726161B2

(12) United States Patent
Canard et al.

(10) Patent No.: US 7,726,161 B2
(45) Date of Patent: Jun. 1, 2010

(54) RETRACTABLE INSERT KEY COMPRISING INSERT DRIVING MEANS

(75) Inventors: Louis Canard, Créteil Cedex (FR); Hervé Calor, Créteil Cedex (FR)

(73) Assignee: Valeo Securite Habitacle, Creteil Cedex (FR)

( * ) Notice: Subject to any disclaimer, the term of this patent is extended or adjusted under 35 U.S.C. 154(b) by 492 days.

(21) Appl. No.: 11/579,625

(22) PCT Filed: May 2, 2005

(86) PCT No.: PCT/EP2005/051988

§ 371 (c)(1),
(2), (4) Date: Nov. 6, 2006

(87) PCT Pub. No.: WO2005/108722

PCT Pub. Date: Nov. 17, 2005

(65) Prior Publication Data

US 2008/0289382 A1 Nov. 27, 2008

(30) Foreign Application Priority Data

May 4, 2004 (FR) ..... 04 04722

(51) Int. Cl.
*A47G 29/10* (2006.01)

(52) U.S. Cl. ..... 70/456 R; 70/396; 70/399; 70/DIG. 52; 206/37.2

(58) Field of Classification Search ..... 70/396, 70/397, 399, 456 R, 459, DIG. 52; 24/3.6; 206/37.1, 37.2, 37.3, 37.5, 38.1; 292/DIG. 61
See application file for complete search history.

(56) References Cited

U.S. PATENT DOCUMENTS

| | | | | | |
|---|---|---|---|---|---|
| 827,201 | A | * | 7/1906 | Ash et al. | 70/399 |
| 1,482,249 | A | * | 1/1924 | Pagliuco | 70/399 |
| 1,750,542 | A | * | 3/1930 | Pucek | 70/355 |
| 3,079,784 | A | * | 3/1963 | Pavlowski | 70/456 R |

(Continued)

FOREIGN PATENT DOCUMENTS

DE 39 02 537 8/1990

(Continued)

OTHER PUBLICATIONS

International Search Report for PCT/EP2005/051988 mailed Nov. 4, 2005 (2 pages).

*Primary Examiner*—LLoyd A Gall
(74) *Attorney, Agent, or Firm*—Osha • Liang LLP

(57) ABSTRACT

A key including a retractable shaft mounted pivotably with respect to a case forming an operating head of the key, between a retracted position in which the shaft extends in a substantially longitudinal direction inside a housing of the case, and a deployed position in which the shaft extends outside the case. The shaft has a first end forming a heel by which the shaft is pivoted about a vertical pivot axis orthogonal to the axis of the shaft. The key includes a drive mechanism for driving the shaft toward one of the retracted position or the deployed operating position. The drive mechanism includes a resiliently deformable element, which exerts a resilient force to return the shaft toward the retracted or deployed position, according to the angular position of the shaft with respect to an intermediate position of the shaft between the deployed position and the retracted position.

10 Claims, 1 Drawing Sheet

U.S. PATENT DOCUMENTS

| | | | | | |
|---|---|---|---|---|---|
| 3,173,280 | A * | 3/1965 | Oberacker | 70/456 R |
| 3,407,636 | A * | 10/1968 | Kovacevic | 70/456 R |
| 4,387,918 | A * | 6/1983 | Dunphy et al. | 292/224 |
| 4,454,737 | A * | 6/1984 | Toyoda | 70/456 R |
| 4,524,594 | A * | 6/1985 | Bascou | 70/456 R |
| 4,637,238 | A * | 1/1987 | Uda et al. | 70/456 R |
| 4,936,123 | A * | 6/1990 | Matsuda | 70/456 R |
| 4,941,569 | A * | 7/1990 | Lindmayer et al. | 206/38.1 |
| 5,046,343 | A * | 9/1991 | Miwa | 70/408 |
| 6,460,386 | B1 * | 10/2002 | Watanuki et al. | 70/456 R |
| 6,705,141 | B1 * | 3/2004 | Müller et al. | 70/408 |
| 2001/0002544 | A1 * | 6/2001 | Schwab | 70/456 R |
| 2006/0144106 | A1 * | 7/2006 | Beresnitzky | 70/456 R |

FOREIGN PATENT DOCUMENTS

| | | |
|---|---|---|
| DE | 102 28 616 | 1/2004 |
| EP | 1 242 704 | 11/2000 |
| FR | 2 816 976 | 5/2002 |
| WO | WO-01 48339 | 11/2000 |
| WO | WO-2004 003856 | 6/2003 |

* cited by examiner

[Fig. 001]
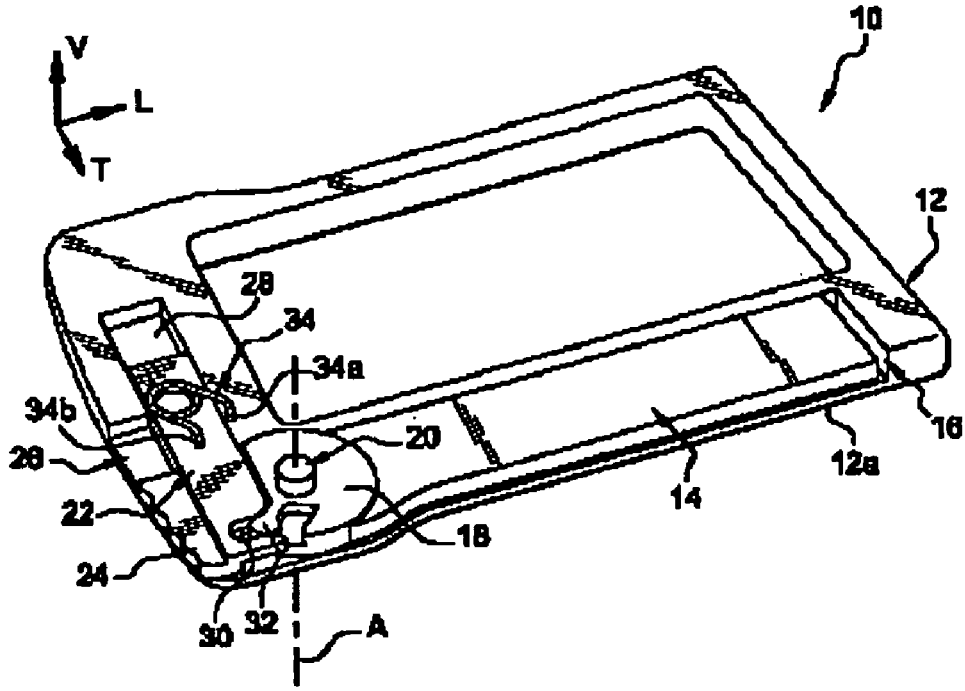
[Fig. 002]
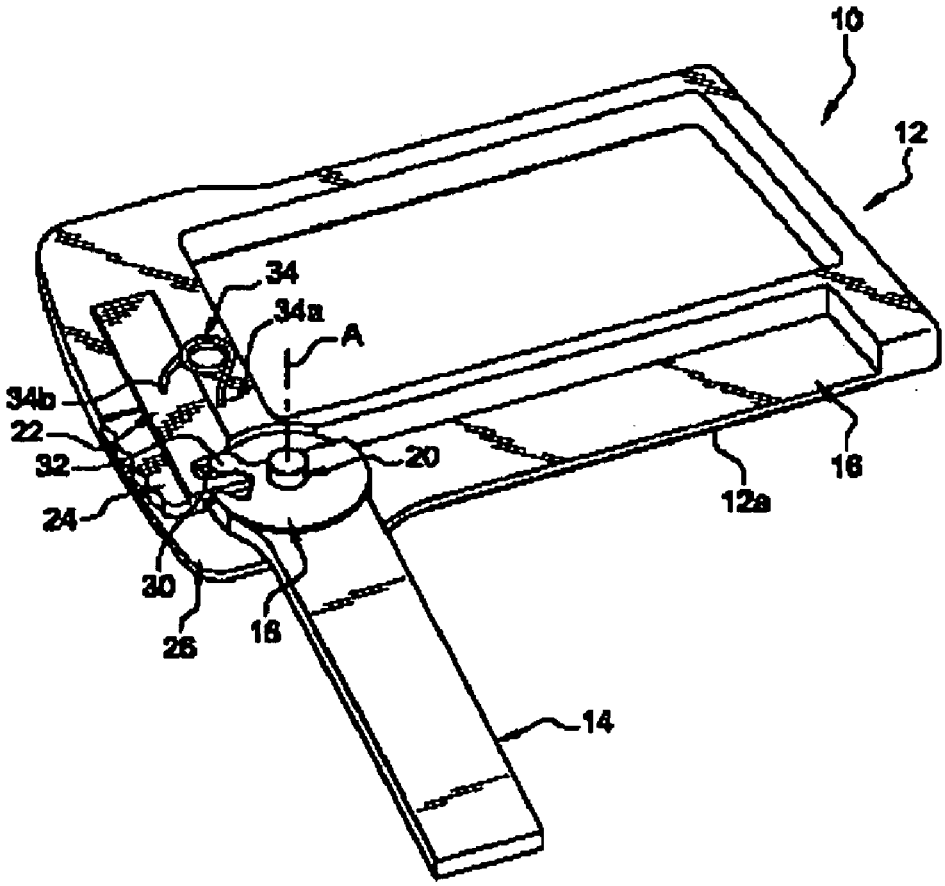

RETRACTABLE INSERT KEY COMPRISING INSERT DRIVING MEANS

FIELD OF THE INVENTION

The invention proposes a key having a shaft, or stem, which can be retracted into the head of the key.

BACKGROUND OF THE INVENTION

More specifically, the invention proposes a key, particularly for an automobile, of the type having a retractable shaft which is mounted pivotably with respect to a case forming the operating head of the key, between a retracted position in which the shaft extends in a substantially longitudinal direction inside a housing of the case, and a deployed operating position in which the shaft extends outside the case, of the type in which the shaft has a first end forming a heel by means of which the shaft is pivoted with respect to the case about a vertical pivot axis orthogonal to the axis of the shaft, and of the type which has means for driving the shaft toward its retracted position or toward its deployed position.

The assembly formed by the shaft and the head of the key is relatively bulky when the shaft extends outside the head of the key.

Moreover, when the key is placed in the pocket of a garment, there is a risk that the shaft will cause premature wear of the pocket, or even create a hole, which is highly detrimental.

To mitigate this drawback, means have been proposed for retracting the shaft into the case forming the head of the key.

Document DE-A-39.02.537 describes a key having a retractable shaft, in which the movement of the shaft from its retracted position toward its deployed operating position is automatic.

The shaft is mounted pivotably in the case by means of a pivot element in which the means for locking the shaft in position are arranged, together with the means for driving the shaft toward its deployed position.

The pivoting of the shaft in this way therefore makes it necessary to use a large number of components, which are also relatively bulky.

These components occupy a considerable volume inside the case of the head, and they greatly reduce the inner volume of the case in which it is possible to position an electronic device, such as a device for remotely controlling the locking of the vehicle doors.

SUMMARY OF THE INVENTION

The object of the invention is to propose a key having a retractable shaft, in which the number of components used for pivoting the shaft with respect to the case, and for driving the shaft toward its deployed or retracted position, is reduced.

For this purpose, the invention proposes a key of the type described above, characterized in that the drive means include a resiliently deformable element (34), which exerts a resilient force on the shaft (14) to return the shaft (14) toward its retracted or deployed position, according to the angular position of the shaft (14) with respect to a predetermined position of the shaft (14) which is intermediate between the deployed position and the folded-back position.

According to other characteristics of the invention,

- the resiliently deformable element has a first end which is connected to the case, and a second end which acts on the heel of the shaft;

- the resiliently deformable element consists of a resilient spring;
- the resiliently deformable element consists of a helical torsion spring having a generally vertical principal axis;
- the second end of the resiliently deformable element acts directly on the heel of the shaft;
- the drive means include an operating element which extends partly outside the case, and which interacts with the heel of the shaft to cause the manual pivoting of the shaft from its retracted position, or from its deployed position, at least up to its intermediate position;
- the second end of the resiliently deformable element acts on the heel of the shaft by means of the operating element, to which the second end of the resiliently deformable element is connected;
- the operating element is mounted inside the case so that it is slidable in a substantially transverse direction, and includes means for converting its sliding movement into a pivoting movement of the shaft about the vertical pivot axis A;
- the means for converting the sliding movement of the operating element include a radial finger of the heel of the shaft, which interacts with a notch in the operating element.

BRIEF DESCRIPTION OF THE DRAWINGS

Other characteristics and advantages of the invention will be made clear by the following detailed description, the comprehension of which will be facilitated by reference to the attached figures, in which:

FIG. 1 is a schematic perspective view of a key according to the invention, in which the shaft is in the retracted position;

FIG. 2 is a view similar to that of FIG. 1, in which the shaft is shown in the deployed operating position.

For the description of the invention, the vertical, longitudinal and transverse orientations indicated in the figures by the frame of reference V, L, T will be used, without restrictive intent.

The orientation from front to rear will also be used, this being the longitudinal direction from left to right as shown in FIG. 1.

DETAILED DESCRIPTION

In the following description, identical, similar or analogous elements will be denoted by the same reference numerals.

FIG. 1 shows a key 10 for operating the mechanism of a latch provided with a lock (not shown) of an automobile, this key having a case 12 and a shaft 14 in the form of a straight stem.

The key 10 also includes an electronic device (not shown) which is mounted inside the case 12.

The case 12 forms the head of the key 10 and enables the key 10 to be operated, particularly for making it pivot in the lock of the latch about the axis of the shaft 14.

The shaft 14 is mounted pivotably with respect to the case 12, about a vertical axis A, between a retracted position shown in FIG. 1, in which the shaft 14 extends inside a housing 16 of the case 12, in a generally longitudinal orientation, and a deployed operating position, shown in FIG. 2, in which the shaft 14 is outside the case 12.

The housing 16, in which the shaft 14 is received when it is in the retracted position, is located on a lateral edge of the case 12, in this case the right-hand lateral edge 12*a*, and is open toward the outside along this right-hand lateral edge 12*a*, to allow the passage of the shaft 14 from or toward its deployed position.

When the shaft 14 is in the deployed position, it extends here with a generally transverse orientation; in other words, it has pivoted through an angle of 90 degrees with respect to its retracted position.

However, it should be understood that the invention is not limited to this embodiment, and that the shaft 14 can pivot through a larger or smaller angle with respect to its retracted position, particularly through an angle of 180 degrees, in which case the shaft 14 extends outside the case 12, with a generally longitudinal forward orientation.

The pivot of the shaft 14 about the vertical axis A, with respect to the case 12, is provided at a first end 18 of the shaft 14 forming a heel, which in this case is the front longitudinal end of the shaft 14, and through which passes a pin 20 which is coaxial with the vertical axis A.

Finally, the key 10 has means for driving the shaft 14 by a pivoting movement about the vertical axis A, toward its retracted position toward its deployed position.

These drive means include an operating element 22 which is movable inside the case 12, and which interacts with the heel 18 of the shaft 14, to cause the pivoting of the shaft 14.

The operating element 22 is actuated manually to cause the pivoting of the shaft 14, and for this purpose it includes a sliding piece 24 which passes through an aperture 26 of the case 12, in such a way that the sliding piece 24 extends partially outside the case 12.

The operating element 22 is mounted movably inside a complementary housing 28 of the case 12 so that it can slide in a transverse direction orthogonal to the longitudinal axis of the shaft 14.

To convert its sliding movement in the housing 28 into a pivoting movement of the shaft 14 about the vertical axis A, the operating element 22 includes a longitudinal notch 30 formed in its rear edge, which interacts with a radial finger 32 of the heel 18.

According to the invention, the means for driving the shaft 14 also include a resiliently deformable element 34, which acts on the shaft 14 to exert a resilient force to return the shaft 14 toward its retracted position, or a resilient force to return the shaft 14 toward its deployed position.

This resilient force for returning the shaft 14 toward one or other of its positions is exerted by the resilient element 34 according to the angular position of the shaft 14 with respect to a predetermined angular position of the shaft 14, which is intermediate between the deployed position and the retracted-position of the shaft 14.

Thus, when the shaft 14 is in an angular position between the deployed position and the predetermined angular position, the resilient element 34 exerts a force returning the shaft 14 toward its deployed position, and conversely, when the shaft 14 is in an angular position between the folded-back position and the predetermined angular position, the resilient element 34 exerts a force returning the shaft 14 toward its folded-back position.

In this case, the resilient element 34 consists of a helical torsion spring, having a vertical principal axis, of which a first end 34*a* is connected to the case 12, and of which a second end 34*b* acts on the heel 18 of the shaft 14.

Furthermore, in this case the resilient element 34 acts on the heel 18 of the shaft 14 by means of the operating element 22. For this purpose, the second end 34*b* of the resilient element 34 is connected to the operating element 22.

However, it should be understood that the invention is not limited to this embodiment, and that the resilient element 34 can act directly on the heel 18 of the shaft 14. For this purpose, the second end 34*b* of the resilient element 34 will be connected directly to the heel 18 of the shaft 14.

To produce the resilient return force on the shaft 14, the resilient element 34 is prestressed by bringing its ends 34*a* and 34*b* toward each other. Thus, the resilient force exerted by the resilient element 34 tends to separate the ends 34*a* and 34*b* of the resilient element 34.

The resilient element 34 is positioned in the case 12 of the key 10 in such a way that the transverse position of the operating element 22 in the case 12 which corresponds to the predetermined angular position of the shaft 14 corresponds to the position of the resilient element 34 in which its ends 34*a* and 34*b* are closest together.

Thus, the resilient force causing the separation of the ends 34*a* and 34*b* of the resilient element 34 causes the operating element 22 to slide in the housing 28 toward the left or the right, this sliding of the operating element 22 corresponding to the pivoting of the shaft 14 toward its retracted position or toward its folded-back position.

To deploy the shaft 14, the user acts on the operating element 22, by means of the sliding piece 24, to cause the pivoting of the shaft 14 about the vertical axis A, at least up to the predetermined angular position.

This action by the user causes the operating element 22 to slide in the housing 28, in this case toward the left with respect to FIG. 1, thus also causing the ends 34*a* and 34*b* of the resilient element 34 to move toward each other.

Thus the user exerts a leftward force on the operating element 22, and the resilient element 34 simultaneously exerts a rightward force, in other words one opposed to the force exerted by the user, on the operating element 22.

When the user continues to apply a force, the shaft 14 moves past its predetermined angular position, and the force generated by the resilient element 34 on the operating element 22 then changes its direction, so that it has the same direction as the force generated by the user on the element 22, in other words toward the left.

The resilient element 34 then returns the operating element 22 toward its extreme left-hand position, corresponding to the deployed position of the shaft 14, shown in FIG. 2, and this then completes the return of the shaft 14 toward its deployed position.

Similarly, in order to make the shaft 14 pivot from its deployed position shown in FIG. 2 to its folded-back position, the user acts on the operating element 22, by means of the sliding piece 24, against the resilient return force generated by the resilient element 34, until the shaft 14 passes beyond its predetermined angular position.

Then, when the shaft 14 has passed beyond this predetermined angular position, the resilient force generated by the resilient element 34 changes its direction, to complete the return of the shaft 14 toward its folded-back position shown in FIG. 1.

Additionally, when the shaft 14 is in its folded-back position, the resilient element 34 continuously exerts a force returning the shaft 14 toward its folded-back position, and when the shaft 14 is in its deployed position, the resilient element 34 exerts a continuous force returning the shaft 14 toward its deployed position.

Thus the resilient element 34 has the additional function of keeping the shaft 14 in the deployed position or in the folded-back position respectively.

The shaft 14 of the key 10 thus has two stable positions, namely the deployed operating position and the folded-back storage position. The key 10 therefore requires no supplementary means of locking the shaft 14 in one or other of its positions.

The invention has been described in relation to a resilient element 34 which consists of a helical torsion spring, acting on the heel 18 of the shaft 14 by means of the operating element 22.

Clearly, however, the invention is not limited to this embodiment, and, on the one hand, the resilient element 34 can consist of another type of spring, for example a helical extension spring, and, on the other hand, the resilient element 34 can act directly on the heel 18 of the shaft 14.

The means for driving the shaft 14 also comprise a relatively small number of components.

This small number of components allows these means to be positioned in part of only one half-shell of the case 12, making a larger part of the inner volume of the case 12 available for positioning the electronic device.

Moreover, this small number of components simplifies the fabrication of the key 10, in terms of both the design of the different components and their assembly.

The cost of production of the key 10 is consequently also reduced.

The invention claimed is:

1. A key comprising a retractable shaft which is mounted pivotably with respect to a case forming an operating head of the key, between a retracted position in which the shaft extends in a substantially longitudinal direction inside a housing of the case, and a deployed operating position in which the shaft extends outside the case, wherein the shaft has a first end forming a heel by means of which the shaft is pivoted with respect to the case about a vertical pivot axis orthogonal to the axis of the shaft, wherein the key further comprises a drive mechanism for driving the shaft toward the retracted position or toward the deployed operating position, wherein the drive mechanism comprises an operating element which extends partly outside the case, and which interacts with the heel of the shaft to cause the manual pivoting of the shaft from the retracted position, or from the deployed position, at least up to a predetermined position, wherein the operating element is mounted movably inside a complementary housing of the case so that it can slide in a transverse direction orthogonal to the longitudinal axis of the shaft in its retracted position, and wherein the drive mechanism comprises a resiliently deformable element, which exerts a resilient force on the shaft to return the shaft toward its retracted or deployed position, according to the angular position of the shaft with respect to the predetermined position of the shaft which is intermediate between the deployed position and the retracted position.

2. The key as claimed in claim 1, wherein the resiliently deformable element has a first end which is connected to the case, and a second end which acts on the heel of the shaft.

3. The key as claimed in claim 1, wherein the resiliently deformable element comprises a resilient spring.

4. The key as claimed in claim 1, wherein the resiliently deformable element comprises a helical torsion spring with a generally vertical axis.

5. The key as claimed in claim 2, wherein the second end of the resiliently deformable element acts directly on the heel of the shaft.

6. The key as claimed in claim 1, wherein the resiliently deformable element has a first end which is connected to the case, and a second end which acts on the heel of the shaft, and wherein;

the second end of the resiliently deformable element acts on the heel of the shaft by means of the operating element, to which the second end of the resiliently deformable element is connected.

7. The key as claimed in claim 1, wherein the operating element includes means for converting its sliding movement into a pivoting movement of the shaft about the vertical pivot axis.

8. The key as claimed in claim 7, wherein the means for converting the sliding movement of the operating element into a pivoting movement of the shaft include a radial finger of the heel of the shaft which interacts with a notch in the operating element.

9. The key as claimed in claim 6, wherein the operating element includes means for converting its sliding movement into a pivoting movement of the shaft about the vertical pivot axis.

10. The key as claimed in claim 9, wherein the means for converting the sliding movement of the operating element into a pivoting movement of the shaft include a radial finger of the heel of the shaft which interacts with a notch in the operating element.

* * * * *